United States Patent [19]

Kaneta

[11] Patent Number: 4,681,079

[45] Date of Patent: Jul. 21, 1987

[54] METHOD OF CONTROLLING FUEL INJECTION

[75] Inventor: Keisuke Kaneta, Hamamatsu, Japan

[73] Assignee: Suzuki Jidosha Kogyo Kabushiki Kaisha, Shizuoka, Japan

[21] Appl. No.: 812,153

[22] Filed: Dec. 23, 1985

[30] Foreign Application Priority Data

Jan. 25, 1985 [JP] Japan ..... 60-11095

[51] Int. Cl.[4] ..... F02D 41/06

[52] U.S. Cl. ..... 123/491; 123/179 L

[58] Field of Search ..... 123/491, 179 L, 179 G

[56] References Cited

U.S. PATENT DOCUMENTS 4,114,570 9/1978 Marchak et al. ..... 123/491
4,478,194 10/1984 Yamato et al. ..... 123/491
4,526,153 7/1985 Hasegawa et al. ..... 123/491

FOREIGN PATENT DOCUMENTS 50-61531 5/1975 Japan .
59-63327 4/1984 Japan .
59-70843 4/1984 Japan .
59-196932 11/1984 Japan ..... 123/491

*Primary Examiner*—Andrew M. Dolinar
*Attorney, Agent, or Firm*—Flynn, Thiel, Boutell & Tanis

[57] ABSTRACT

A fuel injection control method for an internal combustion engine includes the steps of monitoring the rotating speed of the engine and the velocity of the vehicle after the engine has been started using starting fuel injection, and performing fuel injection in an ordinary manner without performing starting fuel injection in the case where either of the following conditions is met: (1) the engine rotating speed is above a predetermined rotating speed or (2) the engine rotating speed is less than the predetermined speed and the vehicle velocity is simultaneously above a predetermined velocity.

3 Claims, 3 Drawing Figures

METHOD OF CONTROLLING FUEL INJECTION

Field of the Invention

The present invention relates to a fuel injection control method and, more particularly, to a fuel injection control method which prevents vibration of the engine when starting movement of the vehicle or the like and which improves the engine's operating efficiency.

BACKGROUND OF THE INVENTION

In electronic fuel injection control methods in which the operating state of an internal combustion engine is monitored and a fuel injection amount is controlled by way of an electrical circuit, several types of injection characteristics are used, including for example starting injection at the start of the engine, injection in the ordinary manner, asynchronous injection, and stop of the injection. Each of these injection characteristics is carried out under respective conditions specified by signals from the sensors monitoring the operating state of the engine, and the fuel injection amount is controlled on the basis of one of the injection characteristics in accord with existing conditions as evidenced by the sensor signals.

In such conventional control methods, the controls which typically invoke starting injection at the start of the engine and ordinary injection during ordinary operation have been disclosed in the Official Gazettes of Japanese Patent Unexamined Publication Nos. 61531/1975 and 63327/1984. Namely, for example, as shown in FIG. 1, upon starting the engine, a starter switch is turned on and invokes the starting fuel injection characteristic to facilitate starting of the engine, thereby increasing a fuel injection amount and improving a starting performance. After completion of the starting of the engine, the starter switch is turned off and a fuel injection in the ordinary manner is performed when the rotating speed $N_e$ of the engine is equal to or greater than a predetermined rotating speed $N_s$. However, starting injection is always carried out and the fuel injection amount is increased until the engine reaches the set rotating speed $N_s$ in order to promptly stabilize the engine when the rotating speed $N_e$ of the engine is lower than the predetermined rotating speed $N_s$, even after completion of the starting of the engine.

When the engine is being operated by injecting the ordinary amount of fuel after starting of the engine, it is possible that the engine rotating speed $N_e$ may temporarily decrease and become lower than the predetermined rotating speed $N_s$, for example due to the application of a load, such as engagement of a clutch in order to initiate movement of a vehicle or the like. Thus, in the foregoing conventional control methods, a low engine speed always causes the injection characteristic to be changed from the characteristic for fuel injection in the ordinary manner to the characteristic for fuel injection at the start of the engine, thereby causing the amount of fuel injected to be increased. Consequently, there is the drawback that a large amount of a rich air-fuel mixture is supplied to the engine and the engine vibrates due to the abnormal burning, causing operating efficiency to be lost.

SUMMARY OF THE INVENTION

It is an object of the present invention to provide a fuel injection control method which, in the case where the rotating speed of an engine decreases, for example when starting movement of a vehicle or the like, fuel injection is not necessarily changed from the characteristic for fuel injection in the ordinary manner to the characteristic for injection at the start of the engine, thereby preventing the occurrence of vibration of the engine due to a rich air-fuel mixture and thus enabling operating efficiency to be improved.

To accomplish this object, in the method of fuel injection according to the present invention, the rotating speed of the engine and the velocity of the vehicle are monitored after completion of the starting of the engine using the starting fuel injection characteristic. Fuel injection in the ordinary manner is performed in the case (1) where the rotating speed of the engine is equal to or greater than the predetermined rotating speed or (2) where the engine rotating speed is less than the predetermined rotating speed but the velocity of the vehicle is equal to or higher than a predetermined velocity.

According to the method of the invention, fuel injection in the ordinary manner is performed when the engine rotating speed measured after starting the internal combustion engine is equal to or greater than the predetermined rotating speed. In the case where the engine rotating speed decreases and becomes lower than the predetermined rotating speed after completion of starting of the engine, if the actual vehicle velocity is equal to or greater than the predetermined velocity, starting fuel injection is not performed but instead fuel injection in the ordinary manner is performed. For example, in the case where the engine rotating speed decreases and becomes a value lower than the predetermined rotating speed because a load is applied by engaging a clutch in order to start movement of the vehicle, the measured vehicle velocity becomes a value above the predetermined velocity due to the start of movement of the vehicle, and therefore fuel injection in the ordinary manner is carried out without performing starting fuel injection. Consequently, according to the invention, when the engine rotating speed decreases as the vehicle is moving, a change of the injection characteristic from ordinary fuel injection to starting fuel injection does not occur as it does in the conventional method, and vibration of the engine due to abnormal burning caused by a rich air-fuel mixture is avoided.

BRIEF DESCRIPTION OF THE DRAWINGS

As embodiment of the present invention will be described in detail hereinbelow with reference to the drawings, in which.

DETAILED DESCRIPTION

Figure 1:
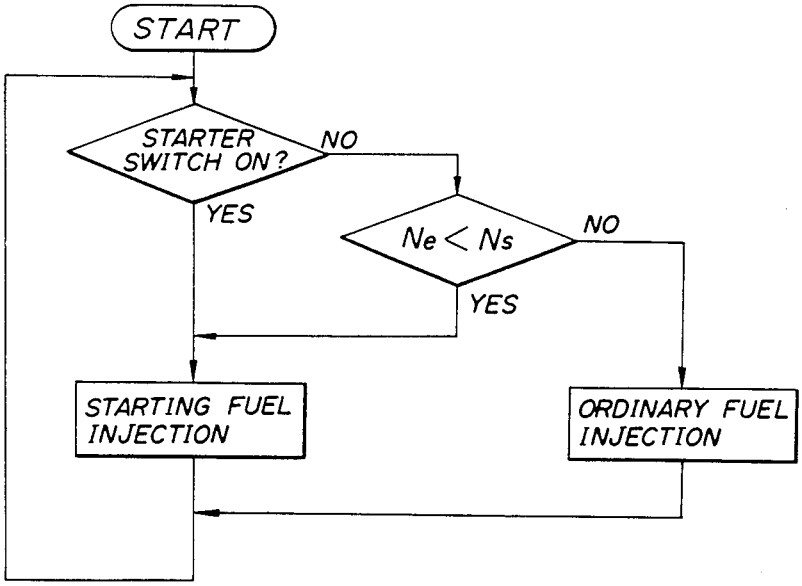
FIG. 1 PRIOR ART
FIG. 1 is a flowchart showing a conventional fuel injection control method.

The control method of the present invention is preferably implemented in an electronic fuel injection control apparatus which is conventional. Therefore, this control apparatus is not shown in the drawings and is only briefly explained hereinbelow for convenience.

In a conventional electronic fuel injection control apparatus, the electronic control section receives various kinds of input signals. For example, these signals typically include: an ON-OFF signal from an idle switch; detection signals which indicate the state of the engine and are output from a coolant temperature sensor, and $O_2$ sensor, an intake air temperature sensor, an air flow meter, etc.; an ignition signal; and the like. In response to these input signals, the control section performs necessary data processing such as comparisons and the like in a conventional manner and outputs control signals to a fuel injection control valve according to the operating state of the engine, thereby allowing smooth operation of the engine to be achieved. Those control signals are varied as necessary to perform fuel injection upon starting of the engine, during ordinary operation, etc., as mentioned above. A suitable amount of fuel is injected in response to each control signal in accordance with the measured conditions.

Figure 2:
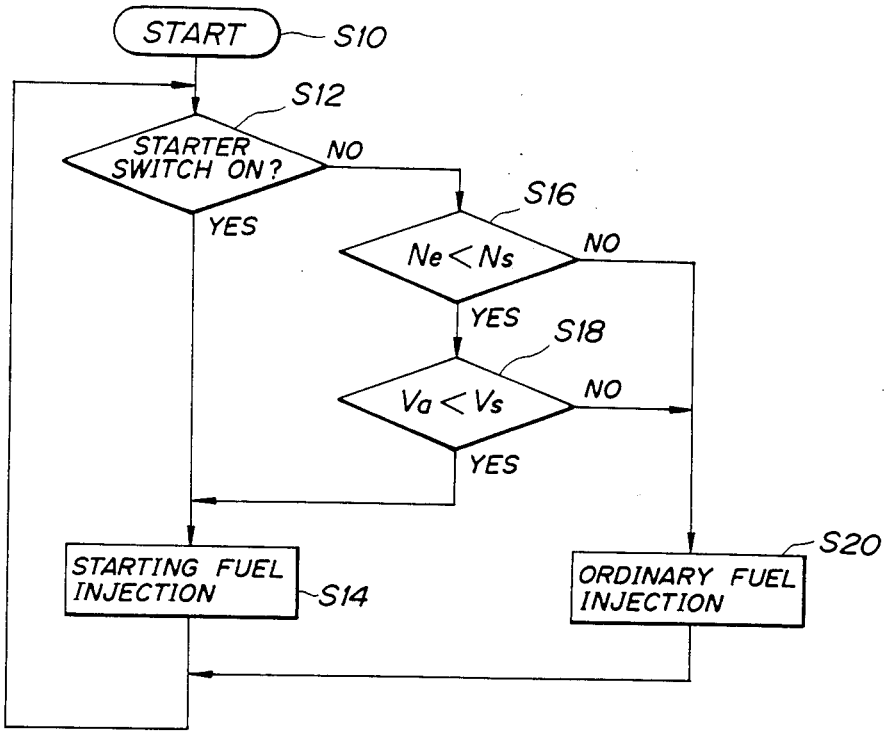
FIG. 2 is a flowchart showing a fuel injection control method according to the present invention.

The fuel injection control method of the present invention will now be explained with reference to the flowchart of FIG. 2. In step S10, engine starting begins. In step S12, a check is made to see if a starter switch has been turned on or off, which switch could for example be the switch controlling the starter motor. If the starter switch is on, fuel injection appropriate for starting the engine is performed in step S14, so that the engine is actuated. After completion of the starting of the engine, the starter switch is turned off (this corresponds to NO in S12), and the processing routine advance to discrimination steps S16 and S18, where the rotating speed $N_e$ of the engine and the velocity $V_a$ of the vehicle are checked.

The rotating speed $N_e$ of the engine is electrically detected by inputting to the control section a signal from an ignition device or the like. The velocity $V_a$ of the vehicle can be detected by way of a conventional sensor of the photoelectric type, electronic type, or electrical contact type. This velocity sensor may be attached to the axle system, speedometer cable system, or distance integrating indicator system in the instrument panel. This velocity sensor produces a signal indicative of the vehicle velocity in the form of an analog, digital or pulse signal proportional to or inversely proportional to the velocity of the vehicle.

If the rotating speed $N_e$ of the engine is equal to or higher than a predetermined rotating speed $N_s$ after the start of the engine, namely if the answer is NO in step S16, fuel injection in the ordinary manner is performed in step S20. On the other hand, after the start of the engine, when the engine rotating speed $N_e$ is less than the set rotating speed $N_s$ and also the velocity $V_a$ of the standing vehicle is less than the set vehicle velocity $V_s$, the fuel injection amount is increased by executing the starting fuel injection until the engine rotating speed $N_e$ reaches the set rotating speed $N_s$ in order to promptly stabilize the engine. When the engine speed $N_e$ exceeds the set speed $N_s$, the ordinary fuel injection is performed. In the conventional control method of FIG. 1, when the rotating speed $N_e$ of an internal combustion engine operating on the basis of ordinary fuel injection decreases to a value lower than the predetermined rotating speed $N_s$, for instance because a load is applied such as where movement of the vehicle is started or the like, fuel injection is changed from ordinary fuel injection to starting fuel injection. Thus, in the conventional method, there is the drawback that engine vibration occurs due to the abnormal burning caused by the rich air-fuel mixture. However, according to the control method of the invention, in the case where the rotating speed $N_e$ decreases and becomes lower than the predetermined rotating speed $N_s$, as in the case of starting movement of the vehicle or the like, the vehicle may be moving. Therefore, according to the invention, if the measured vehicle velocity $V_a$ is equal to or higher than the predetermined velocity $V_s$, namely the answer is NO in step S18, ordinary fuel injection is performed in step S20 without executing starting fuel injection. However, when the vehicle velocity $V_a$ is lower than the predetermined velocity $V_s$, starting fuel injection is performed in step S14.

Figure 3:
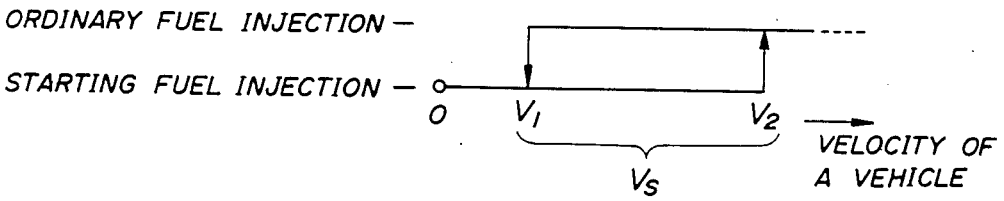
FIG. 3 is a diagram showing the change in fuel injection according to the invention in dependence on the velocity of a vehicle.

The predetermined velocity $V_s$ is set to be an extremely low velocity in consideration of a hysteresis curve (FIG. 3) defining changes between starting fuel injection and ordinary fuel injection as a function of slight vehicle velocity. In other words, the predetermined velocity $V_s$ is set to a very low value in a manner so that the fuel injection characteristic is changed from ordinary fuel injection to starting fuel injection at a low velocity $V_1$ at a low position on the hysteresis curve in the case where the vehicle velocity decreases while the internal combustion engine is operating under ordinary fuel injection. On one hand, when the fuel injecting mode is shifted from the ordinary fuel injection to the starting fuel injection due to a decrease in vehicle velocity and thereafter the vehicle velocity increases due to the operation of the internal combustion engine in the starting fuel injection mode, the set vehicle in the starting fuel injection mode, the set vehicle velocity $V_s$ is set such that the fuel injecting mode is shifted from the starting fuel injection to the ordinary fuel injection at a vehicle velocity $V_2$ at a high position of the hysteresis. Therefore, the set vehicle velocity $V_s$ is set to a very low velocity and also a value within a range including a vehicle velocity $V_1$ at a low position of the hysteresis and the vehicle velocity $V_2$ at a high position of the hystersis. On the other hand, the fuel injection can be also controlled in a manner such that the starting fuel injection is performed after an expiration of a predetermined time period after the vehicle velocity $V_a$ detected has been reduced to 0. In this way, the engine stall of internal combustion engines can be prevented.

As described above, even if the rotating speed $N_e$ of the engine temporarily decreases upon starting movement of a vehicle or the like, it is possible to prevent engine vibration due to the abnormal burning caused by a rich air-fuel mixture, because the fuel injection characteristic is changed to the starting fuel injection as in a conventional method, therby enabling the operating efficiency to be improved. In the special case where an internal combustion engine is started by pushing a vehicle, when the engine has been completely started by using starting fuel injection and by pushing the vehicle, the engine is then operated by checking to see whether the engine rotating speed and the vehicle velocity exceed the predetermined values, according to FIG. 2. Therefore, special starting of the engine by pushing the vehicle can be performed in a conventional manner and it is possible to prevent the occurrence of vibration of the engine due to the change of the fuel injection characteristic to starting fuel injection after starting of the engine.

As described above, according to the control method of the invention, in the case where the engine rotating speed decreases upon starting movement of a vehicle or the like, fuel injection is not necessarily changed from ordinary injection starting injection, so that the occurrence of engine vibration due to a rich air-fuel mixture is prevented and operating efficiency can be improved.

In addition, starting of the engine by manually pushing the vehicle can be performed as with a conventional vehicle.

What is claimed is:

1. A method of fuel injection control for an internal combustion engine in a vehicle, comprising the steps of:

performing starting fuel injection during starting of the engine; and thereafter monitoring the rotating speed of the engine and the velocity of the vehicle, and:

A. performing starting fuel injection when the engine speed is less than predetermined speed and the vehicle velocity is simultaneously less than a first predetermined velocity, and then continuing to perform starting fuel injection so long as the engine speed is less than said predetermined speed and said vehicle velocity is simultaneously less than a second predetermined velocity slightly greater than said first predetermined velocity;

B. performing fuel injection in an ordinary manner whenever the engine speed is greater than or equal to said predetermined speed; and C. performing fuel injection in an ordinary manner when the vehicle velocity is greater than or equal to said second predetermined velocity, and then continuing to perform fuel injection in an ordinary manner so long as the vehicle velocity is greater than or equal to said first predetermined velocity.

2. A control method according to claim 1, wherein said step of performing starting fuel injection during starting of the engine is carried out when a starter switch is on.

3. A control method according to claim 1, wherein said first predetermined velocity is slightly greater than zero.

* * * * *